United States Patent [19]

Clark

[11] 3,944,702

[45] Mar. 16, 1976

[54] FIBROUS STRUCTURES BONDED WITH A SILSESQUIOXANE-CONTAINING COMPOSITION

[75] Inventor: Harold A. Clark, Midland, Mich.

[73] Assignee: Dow Corning Corporation, Midland, Mich.

[22] Filed: June 24, 1974

[21] Appl. No.: 482,298

[52] U.S. Cl. ..... 428/288; 252/313 S; 427/387; 427/402; 428/391; 428/392; 428/920

[51] Int. Cl.[2] ..... D04H 1/58

[58] Field of Search..... 117/126 GS, 140 A, 169 A, 117/161 ZA; 161/170; 252/313 S; 260/448.2 R; 427/387, 402, 388, 392, 393, 394; 428/391, 392, 393, 394, 395, 920, 921, 288

[56] References Cited

UNITED STATES PATENTS

| | | | |
|---|---|---|---|
| 2,528,554 | 11/1950 | Rust | 260/448.2 R |
| 2,676,182 | 4/1954 | Daudt et al. | 252/313 S |
| 2,688,007 | 8/1954 | Steinman | 117/161 |
| 2,721,856 | 10/1955 | Sommer | 117/126 |
| 2,881,146 | 4/1959 | Remer | 117/161 |
| 3,234,179 | 2/1966 | Katch et al. | 117/126 |
| 3,445,267 | 5/1969 | Layne | 117/126 |
| 3,472,729 | 10/1969 | Sterman et al. | 117/126 |
| 3,619,278 | 11/1971 | Ogawa | 117/161 |
| 3,624,030 | 11/1971 | Pruvost | 117/161 |
| 3,759,740 | 9/1973 | Campbell | 117/126 |

*Primary Examiner*—Ralph Husack
*Assistant Examiner*—Sadie L. Childs
*Attorney, Agent, or Firm*—Norman E. Lewis

[57] ABSTRACT

A binder composition of colloidal silica and silsesquioxane polymer ($RSiO_{3/2}$) is applied to fibrous masses from an acidified water-alcohol vehicle to fabricate coherent three-dimensional structures, such as bonded asbestos mats.

14 Claims, No Drawings

FIBROUS STRUCTURES BONDED WITH A SILSESQUIOXANE-CONTAINING COMPOSITION

BACKGROUND OF THE INVENTION

The present invention relates to improved binder compositions. In one aspect, the invention relates to coherent, three-dimensional fibrous structures containing a novel binder. In another aspect, the invention relates to a process for the fabrication of coherent fibrous structures, such as fiberglass thermal insulation.

Resin bonded fibrous materials are well-known items of manufacture which have numerous uses, such as thermal insulation, acoustical barriers, electrical insulation and the like. Binder resins, generally used in fibrous sheets, fabrics and laminates, are the phenolics, melamines, silicones, caseins and epoxies. The fibers used in the manufacture of such items include cellulosic fibers such as wood fibers and cotton; nylon, rayon, polyesters, glass and asbestos. The nature of the binder resin has a direct effect on the physical properties of the fibrous item. The flammability of binder resins, especially in thermal insulation, has been a special concern of the industry.

The present invention provides an improved binder composition which is economical as well as substantially non-burning. When used to impregnate or otherwise coat fibrous masses, the binder provides a strong coherent structure which has increased resistance to burning.

Thus, it is an object of the present invention to provide an improved binder composition.

It is another object of the invention to provide a method of fabricating coherent fibrous structures.

A further object of the present invention is to provide a three-dimensional fibrous structure having reduced flammability characteristics.

These and other objects of the present invention will be apparent to one skilled in the art upon consideration of the following disclosure and appended claims.

DETAILED DESCRIPTION OF THE INVENTION

In accordance with the present invention, there is provided a coherent three-dimensional structure comprising a plurality of contiguous fibers, said fibers being bonded at their points of contact with a composition consisting essentially of 10 to 75 weight percent colloidal silica uniformly dispersed in a matrix of 25 to 90 weight percent $RSiO_{3/2}$ in which R is selected from the group consisting of alkyl radicals of 1 to 3 inclusive carbon atoms, the vinyl radical, the 3,3,3-trifluoropropyl radical, the gamma-glycidoxypropyl radical and the gamma-methacryloxypropyl radical, at least 70 weight percent of the matrix being $CH_3SiO_{3/2}$.

Further, the invention encompasses a method of fabricating a coherent three-dimensional structure comprising coating a plurality of contiguous fibers with sufficient binder composition to bond said fibers at their points of contact; said binder composition consisting essentially of a dispersion of colloidal silica in a lower aliphatic alcohol-water solution of the partial condensate of a silanol of the formula $RSi(OH)_3$ in which R is selected from the group consisting of alkyl radicals of 1 to 3 inclusive carbon atoms, the vinyl radical, the 3,3,3-trifluoropropyl radical, the gamma-glycidoxypropyl radical and the gamma-methacryloxypropyl radical, at least 70 weight percent of the silanol being $CH_3Si(OH)_3$, said composition containing 1 to 40 weight percent solids consisting essentially of 10 to 75 weight percent colloidal silica and 25 to 90 weight percent of the partial condensate, said composition containing sufficient acid to provide a pH in the range of 3.0 to 6.0; and therefore curing said partial condensate.

The binder composition utilized in the above-described method is a solution dispersion containing from about 1 to 40 weight percent solids based on the weight of colloidal silica and partial condensate present in the vehicle. The major portion of the partial condensate is that of $CH_3Si(OH)_3$; a minor amount (30% or less) of the siloxanol being obtained from cocondensation with $C_2H_5Si(OH)_3$, $C_3H_7Si(OH)_3$,

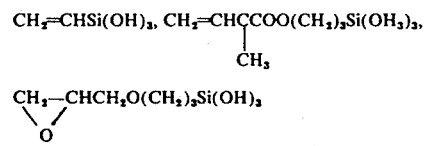

and mixtures thereof. From both the standpoint of economy and nonflammability properties in the cured binder, it is preferred to utilize all monomethyltrisilanol in formulating the vehicle. The presence of at least 70 weight percent of $CH_3SiO_{3/2}$ in the siloxane component of the composition provides a binder of low organic content. Reduction of the organic content of the resin is a major factor in obtaining low flammability.

The trisilanols, $RSi(OH)_3$, are generated in situ by adding the corresponding trialkoxysilanes to an acidic aqueous dispersion of colloidal silica. Exemplary trialkoxysilanes are those containing methoxy, ethoxy, isopropoxy and t-butoxy substituents which upon hydrolysis liberate the corresponding alcohol; thus, generating at least a portion of the alcohol present in the fluid binder. Upon generation of the silanol in the acidic aqueous medium, there is condensation of the hydroxyl substituents to form —Si—O—Si— bonding. The condensation takes place over a period of time and is not complete, but rather, the siloxane retains an appreciable quantity of silicon-bonded hydroxyl groups which render the polymer soluble in the alcohol-water cosolvent. This soluble partial condensate can be characterized as a siloxanol polymer having at least one silicon-bonded hydroxyl group per every three -SiOSi- units. During curing of the binder, these residual hydroxyls condense to provide a silsesquioxane, $RSiO_{3/2}$.

The silica component of the composition is present as colloidal silica. Aqueous dispersions generally contain colloidal silica having a particle diameter size in the range of 5 to 150 millimicrons. These silica hydrosols are prepared by methods well-known in the art and are commercially available under such registered trademarks as "Ludox" and "Nalcoag". It is preferred to use colloidal silica of 15–60 millimicron particle size in order to provide greater shelf life in the binder composition. Colloidal silicas of this type are relatively free of $Na_2O$ and other metal oxides, generally containing less than 2 weight percent and preferably less than 1 weight percent $Na_2O$. These silicas are available as both acidic and basic hydrosols. Colloidal silica is to be distinguished from other water dispersible forms of $SiO_2$, such as polysilicic acid or alkali metal silicates which are not within the scope of the present invention.

The binder consists of silica dispersed in a solution of the siloxanol in a lower aliphatic alcohol-water cosolvent. Suitable lower aliphatic alcohols are water miscible and include methanol, ethanol, isopropanol and t-butanol. Of course mixtures of such alcohols can be utilized. Isopropanol is the preferred alcohol and when mixtures of alcohol are used, it is preferred that at least 50 weight percent of isopropanol be present in such mixture. The solvent system should contain from about 20 to 65 weight percent alcohol to ensure solubility of the siloxanol. Optionally minor amounts (no more than 20 weight percent) of a water-miscible polar solvent, such as acetone, butyl cellosolve and the like, can be present in the cosolvent system.

To provide shelf life and minimize gellation in the binder composition, sufficient inorganic or water-miscible organic acid to provide a pH of from 3.0 to 6.0 must be present. Suitable acids include both organic and inorganic acids such as hydrochloric, acetic, chloroacetic, citric, benzoic, dimethylmalonic, formic, glutaric, glycolic, maleic, malonic, toluene-sulfonic, oxalic and the like. The specific acid utilized has a direct effect on the rate of silanol condensation which in turn determines shelf life of the composition. The stronger acids, such as hydrochloric and toluenesulfonic acid, give appreciably shortened shelf or bath life and require less ageing to obtain the described soluble partial condensate. It is preferred to add sufficient water-miscible carboxylic acid selected from the group consisting of acetic, formic, propionic and maleic acids to provide pH in the range of 4 to 5.5 in the binder composition. In addition to providing good bath life, the alkali metal salts of these acids are soluble, thus allowing the use of these acids with silicas containing a substantial (greater than 0.2% $Na_2O$) amount of alkali metal or metal oxide.

The binder is easily prepared by adding trialkoxysilanes, such as $RSi(OCH_3)_3$, to colloidal silica dispersion after adjusting the pH of the dispersion to the desired level by addition of the acid, or the acid can be added to either the silane or the hydrosol prior to mixing the two components, provided that the mixing is done rapidly. The amount of acid necessary to obtain the desired pH will vary with the alkali metal content of the silica but is usually less than one weight percent of the composition. Alcohol is generated by hydrolysis of the silicon-bonded alkoxy substitutents, for example, hydrolysis of one mole of $-Si(OC_2H_5)_3$ generates three moles of ethanol. Depending upon the percent solids desired in the final composition, additional alcohol, water or a water-miscible solvent can be added. The binder composition should be well mixed and allowed to age for a short period of time to ensure formation of the partial condensate. The composition thus obtained is a clear or slightly hazy low viscosity dispersion which is stable for several days. The condensation of $\equiv$ SiOH continues at a very slow rate and the composition will eventually form gel structures. The bath life of the composition can be extended by maintaining the dispersion at below room temperature, for example at 40°F.

Buffered latent condensation catalysts can be added to the composition so that milder curing conditions can be utilized to obtain the optimum properties in the final coating. Alkali metal salts of carboxylic acids, such as potassium formate, are one class of such latent catalysts. The amine carboxylates and quaternary ammonium carboxylates are another such class of latent catalysts. Of course, the catalysts must be soluble or at least miscible in the cosolvent system. The calalysts are latent to the extent that at room temperature they do not appreciably shorten the bath life of the composition, but upon heating the calalyst dissociates and generates a catalytic species active to promote condensation, for example an amine. Buffered catalysts are used to avoid effects on the pH of the composition. Certain of the commercially available colloidal silica dispersions contain free alkali metal which reacts with the organic acid during the adjustment of pH to generate the carboxylate catalyst in situ. This is particularly true when starting with a hydrosol having a pH of 8 or 9. The binder can be catalyzed by addition of carboxylates such as dimethylamine acetate, ethanolamine acetate, dimethylaniline formate, tetraethylammonium benzoate, sodium acetate, sodium propionate, sodium formate or benzyltrimethylammonium acetate. The amount of catalyst can be varied depending upon the desired curing condition, but above about 1.5 weight percent catalyst in the vehicle, the shelf life is shortened and the physical properties of the resin may be impaired. It is preferred to utilize from about 0.05 to 1 weight percent of the catalyst.

To provide the greatest stability in the dispersion while obtaining optimum properties in the cured binder, it is preferred to utilize a binder composition having a pH in the range of 4–5 which contains 1 to 10 weight percent solids; the silica portion having a particle size in the range of 10–60 millimicrons; the partial condensate of $CH_3Si(OH)_3$ being present in an amount in the range of 35 to 55 weight percent of the total solids in a cosolvent of methanol, isopropanol and water, the alcohols representing from 30 to 60 weight percent of the cosolvent and a catalyst selected from the group consisting of sodium acetate and benzyltrimethylammonium acetate being present in an amount in the range of 0.05 to 0.5 weight percent of the composition. Such a vehicle is relatively stable, having a shelf life of approximately one month. When coated onto fibers, the binder can be cured in a relatively short time at temperatures in the range of 75°–125°C.

The liquid binder compositions can be coated onto a fibrous mass using conventional application techniques. For example, if the fibers are in the form of a sheet fabric, mat or web, the structure can be impregnated by spraying, dipping, brushing and the like. Discrete or individual fiber masses can be coated with the binder composition, formed into a structure and then cured to obtain fibers bonded to one another at their points of contact. For example, asbestos fibers can be slurried in the liquid binder and then sprayed into a mold or onto a surface to form a thermal insulation material. The optimum percent solids (colloidal silica and partial condensate) in the liquid binder composition will vary with the nature of the fiber and the method of coating but will generally be in a range of from 1 to 40 weight percent solids. When spraying fiberglass batts, a composition containing 2 to 10 weight percent solids has been found to be very effective.

After application of the binder composition to a fibrous mass, the solvent component is evaporated and the siloxane portion cured. Curing via further condensation of the silanol functionality to form $\equiv$ SiOSi $\equiv$ bonds will take place at room temperature but exposure to higher temperatures accerlates the cure rate. Complete curing is obtained in less than 30 minutes at 230 °C or in the case of cellulosic fibers can be carried out at least 85°C. for 12 hours.

Upon curing there is obtained a fibrous structure, the fibers therein being bonded at their points of contact with a composition consisting essentially of 10 to 75 weight percent colloidal silica and 25 to 90 weight percent silsesquioxane polymer of the formula $RSiO_{3/2}$ in which R has been previously described. It should be understood that the polymer need not be completely condensed and that the resin may contain residual hydroxyl substituents. The residual hydroxy content of such a resin may be as great as 10 weight percent calculated at % ≡ SiOH. Resilient fiber masses coated with the binder may be confined under pressure during the curing step to ensure that contiguous fibers are bonded at their points of contact. The amount of cured binder composition present in the structure can be varied with the method of application and nature of the fiber but is generally in the range of from 1 to 30 weight percent of the article. The articles obtained by the practice of the invention have a strong, coherent three dimensional structure which has numerous applications in industry.

Fibers suitable for fabrication of the structures include cellulosic, inorganic, polymeric or metallic type fibers and mixtures thereof. Exemplary cellulosic fibers include wood cellulose, such as pulps derived from hardwood, softwoods and woody annual plants, hemp, cotton, and jute. In organic fibers which can be utilized are glass, asbestos, titanium dioxide, aluminum oxide, graphite and the like. Suitable synthetic polymeric fibers are those formed from both homopolymeric and copolymeric materials such as vinyl resins formed by polymerization of vinyl halides or copolymerization of a vinyl halide with a vinyl ester; polyolefins, for example polyethylene or polypropylene; polyurethanes; polyamides, for example polyhexamethylene adipamide; acrylics, polyesters, polyaldehydes and cellulose esters such as nitrates, acetates and propionates. Metallic fibrous structures include those fabricated from fibers of iron, copper, aluminum, steel, titanium and the like. Hollow fibers can be utilized if desired. The fibers may be pretreated or coated with a priming agent to promote adhesion of the binder resin. It is necessary, of course, that a plurality of fibers be present in adequate number and be spacially arranged to provide the fiber to fiber contact necessary to obtain the desired physical properties in the final structure. Thus, the fibers may be in the form of a sheet, web, mat, fabric, tow, bundle, laminate or the like.

It is also within the scope of the invention to utilize conventional additives in fabricating the articles of the present invention. Materials such as pigments, dyes, antioxidants and antistatic agents may be utilized. The fibrous structure can also contain specific materials necessary to obtain a special property necessary to the end use of the particular article. For example, in fabricating acoustical tile, vermiculite or perlite are often present in combination with the fibers.

Regarding materials to be utilized as thermal insulation, a preferred structure is that of fiberglass nonwoven mats (batts) bonded with a composition comprising 30 to 50 weight percent $SiO_2$ (colloidal silica) and 50 to 70 weight percent $CH_3SiO_{3/2}$, the binder loading of such a structure being in the range of 3 to 25 weight percent. When utilized with glass fibers, this specific binder composition gives optimum retention of strength at elevated temperatures while being essentially nonflammable.

The following examples are exemplary and not intended as limiting the invention which is delineated in the claims.

EXAMPLE 1

One gram of glacial acetic acid was combined with 50 grams of an aqueous dispersion of 13–14 millimicron colloidal silica (30% solids and 0.32% $Na_2O$) after which 30.4 grams of methyltrimethoxysilane were added. After mixing for one hour, the binder composition was filtered. The composition contained 50 weight percent $SiO_2$ and 50 weight percent the partial condensate (calculated on the weight $CH_3SiO_{3/2}$) in a methanol-water medium. After aging for two-days to ensure formation of the partial condensate, portions of the composition were diluted with isopropanol to produce a series of binders containing from 0.4 to 3.2 weight percent solids having a pH in the range of 4.5 to 5.2.

Six specimens, approximately 100 mm. wide × 305 mm. long × 27.7 mm. thick were cut from glass fiber mat which had been heat-cleaned for 72 hours at 350°C. to remove the starch sizing. The mats had a density of about 0.25 lb./cu. ft. Five of the fiberglass mats were coated with the isopropanol diluted compositions by spraying until the mat appeared thorougly wet. The sixth portion was used as an untreated control.

The above-described fiberglass mats were placed between metal plates separated by 27.7 mm. spacers and cured for 16 hours at 85°C. After removal from the curing oven, each specimen was weighed. To determine the degree of bonding, the thickness of each mat was measured under a compressive load of 0.62 gm/cm². A metal plate weighting 190 grams and measuring 100 mm. 33 305 mm. was placed on the cured mats and six measurements were made around the perimeter to obtain an average thickness.

To determine if the cured binder deteriorated at high temperatures, the coated specimens were placed in a 350°C. oven under a load of 0.62 gm/cm². After 100 hours, the compressed mats were removed from the oven, weighed and the thickness was again measured. Results of this testing are tabulated below:

| Fiberglass Mat | % Solids in Coating Composition | Mat Weight (gms) After 16 hrs. at 85°C. | Mat Weight (gms) After 100 hrs. at 350°C. | Mat Thickness (mm) After 16 hrs. at 85°C. | Mat Thickness (mm) After 100 hrs. at 350°C. |
|---|---|---|---|---|---|
| No. 1 | uncoated control | 3.3 | — | 2.0 | — |
| No. 2 | 0.4 | 3.3 | 3.3 | 3.0 | 1.3 |
| No. 3 | 0.8 | 3.0 | 3.2 | 5.7 | 1.8 |
| No. 4 | 1.6 | 4.5 | 4.5 | 12.8 | 7.7 |
| No. 5 | 3.2 | 5.4 | 5.3 | 19.2 | 14.2 |

One heat-aged mat No. (5) was compressed to 50% of its thickness and held for about two minutes at room temperature. When the compressive force was removed the mat returned to greater than 95% of its previous thickness.

These data demonstrate that strong coherent glass fiber structures resistant to high temperature can be obtained by practice of the invention.

EXAMPLE 2

Four different binder compositions containing from 25 to 50 weight percent partial condensate (calculated as % $CH_3SiO_{3/2}$) and 50 to 75 weight percent $SiO_2$, based on the solids content, were prepared by adding the appropriate amounts of methyltrimethoxysilane to portions of an aqueous dispersion of colloidal silica containing 34% $SiO_2$, less than 0.01 $Na_2O$ having an average particle size of 16–22 millimicron diameter to which acetic acid had been previously added. The compositions were shaken for one hour after which the pH of each was determined to be in the range of from 4.0 to 4.5. After aging for four days the compositions were diluted to 4 weight percent solids by addition of isopropanol.

Heat-cleaned glass fiber mats, similar to those described above, except 56 mm. thick, were weighed then sprayed until thoroughly wet with one of the binder compositions. A fifth mat was uncoated and used as a control. The mat specimens were placed between metal plates separated by 56 mm. spacers and cured for 15 minutes at 232°C. After curing the specimens were weighed, binder content calculated and thickness was measured under a 0.62 gm./cm² load as described in Example 1. The coated mats were heat-aged for 100 hours at 350°C. under compression as previously described. Results of this evaluation are tabulated below:

| Mat | % $CH_3SiO_{3/2}$ in Binder | Binder Loading - % | Mat Weight (gms) After Curing | Mat Weight (gms) After Heat Ageing | Mat Thickness (mm) After Curing | Mat Thickness (mm) After Heat Ageing |
|---|---|---|---|---|---|---|
| No. 1 | control | none | 6.1 | — | 4.3 | — |
| No. 2 | 25 | 18.0 | 7.2 | 7.1 | 15.5 | 8.7 |
| No. 3 | 30 | 10.6 | 7.3 | 7.4 | 30.0 | 21.3 |
| No. 4 | 40 | 12.9 | 7.0 | 6.8 | 32.5 | 21.3 |
| No. 5 | 50 | 15.6 | 7.4 | 7.3 | 41.8 | 28.7 |

These data demonstrate that while the lower monomethylsilsesquioxane content (25%) gives some retention of strength at elevated temperatures, a monomethyl content of 30 weight percent and above give substantial improvements in retained strength.

Two of the above specimens (No. 4 and No. 5) were held over the direct heat of a laboratory burner. Although the glass fibers melted away from the heat and a silica deposit formed on the fibers due to the decomposition of the binder, there was no smoke nor was a flame emitted. When the specimens were removed from the burner flame, no residual flame was observed.

EXAMPLE 3

A series of binder compositions containing from 50 to 100 weight percent $CH_3SiO_{3/2}$ and 0 to 50 weight percent $SiO_2$, based on the solids content, were prepared by the manner described in Example 2, except that the 30% solids colloidal dispersion of Example 1 was utilized as the silica component. After ageing for three days, the 4% resin solids in isopropanolmethanol-water cosolvent were sprayed onto 56 mm. thick fiberglass mats and cured for 15 minutes at 232°C. between metal plates separated by 56 mm. spacers. After curing the specimens were weighed, binder loading calculated and the thickness measured under the 0.62 gm./cm² load as previously described. Results were as follows:

| Mat | % $CH_3SiO_{3/2}$ in Binder | Binder Loading % | Thickness* (%) |
|---|---|---|---|
| No. 1 | 50 | 9.3 | 70.5 |
| No. 2 | 70 | 7.1 | 68.4 |
| No. 3 | 90 | 6.7 | 60.5 |
| No. 4 | 100 | 5.8 | 44.4 |

*Thickness under 0.62 gm./cm² load × 100 / Thickness under no load

It is apparent from these data and the data of Example 2 that superior strength is obtained when from 30 to 90 weight percent of the binder is the silsesquioxane. The optimum retention of thickness for this glass fiber structure is obtained with a binder containing from 50 to 70 weight percent $CH_3SiO_{3/2}$. Further testing showed that a 50% $CH_3SiO_{3/2}$ - 50% $SiO_2$ binder resin applied to the fiberglass mat from a 6% solids solution/dispersion gave a binder loading of 11.9% resin, with the mat retaining 82.5% of its original thicknes when compressed with the 0.62 gm./cm² load.

EXAMPLE 4

The binder composition of Example 1 was utilized to coat asbestos fibers which were molded in the form of tensile bar specimens. After ageing, the binder composition was diluted to 5% solids with isopropanol. The dilute binder (200 grams) was utilized to coat 90 grams of chrysolite asbestos fibers loosely contained in a dogbone shaped mold. Six specimens were fabricated. The asbestos structures were cured at 200 °C. for 2 hours and then retained at 80°C. for 12 hours to ensure removal of all of the binder cosolvent.

Two of the structures were heat-aged for about 96 hours at 350°C. while another pair were exposed to 100% relative humidity at 33°C. for 96 hours. The heat-aged material exhibited about 1% weight loss and the specimens in the humidity chamber picked up less than ½% water. The tensile strengths of the specimens were in the range of 25 to 40 psi.

The specimens were exposed to a Bunsen burner flame and did not ignite or emit smoke.

EXAMPLE 5

Shredded tissue paper was coated with the dilute binder of Example 4 and molded in the form of a tensile bar specimen. Excess binder was squeezed from the molded specimen. After curing for 12 hours at 50°C. and for one hour at 125°C., the cellulosic structure was determined to contain 75 weight percent $CH_3SiO_{3/2}$—$SiO_2$ binder. The structure had a tensile strength of 27 psi and exhibited flame retardant properties.

Reasonable modification and variation are within the scope of the present invention which is directed to resin-bonded fibrous structures and a method for fabricating such structures.

That which is claimed is:

1. A coherent three-dimensional structure comprising a plurality of contiguous fibers, said fibers being bonded at their points of contact with a composition consisting essentially of 10 to 75 weight percent colloidal silica uniformly dispersed in a matrix of 25 to 90 weight $RSiO_{3/2}$ in which R is selected from the group consisting of alkyl radicals of 1 to 3 inclusive carbon atoms, the vinyl radical, the 3,3,3-trifluoropropyl radical, the gamma-glycidoxypropyl radical and the gamma-methacryloxypropyl radical, at least 70 weight percent of the matrix being $CH_3SiO_{3/2}$.

2. A structure in accordance witn claim 1 wherein said matrix portion is $CH_3SiO_{3/2}$.

3. A structure in accordance witn claim 2 wherein the fibers are selected from the group consisting of cellulosic fibers, inorganic fibers, synthetic polymeric fibers, and metallic fibers.

4. A structure in accordance with claim 3 wherein the fibers are inorganic fibers.

5. A structure in accordance with claim 4 wherein the fibers are glass fibers.

6. A structure in accordance with claim 1 wherein the binder composition comprises 3 to 25 weight percent of the structure.

7. A structure in accordance with claim 1 comprising a plurality of glass fibers in the form of a nonwoven mat, said fibers being bonded at their points of contact with a composition consisting essentially of about 30 to 50 weight percent of colloidal silica dispersed in a matrix of about 50 to 70 weight percent $CH_3SiO_{3/2}$, said composition being present in an amount in the range of from 3 to 25 weight percent, based on the total weight of the structure.

8. A method of fabricating a coherent three-dimensional structure comprising coating a plurality of contiguous fibers with sufficient binder composition to bond said fibers at their points of contact; said binder composition consisting essentially of a dispersion of colloidal silica in a lower aliphatic alcohol-water solution of the partial condensate of a silanol of the formula $RSi(OH)_3$ in which R is selected from the group consisting of alkyl radicals of 1 to 3 inclusive carbon atoms, the vinyl radical, the 3,3,3-trifluoropropyl radical, the gamma-glycidoxypropyl radical and the gammamethacryloxypropyl radical, at least 70 weight percent of the silanol being $CH_3Si(OH)_3$, said composition containing 1 to 40 weight percent solids consisting essentially of 10 to 75 weight percent colloidal silica and 25 to 90 weight percent of the partial condensate, said composition containing sufficient acid to provide a pH in the range of 3.0 to 6.0; and thereafter curing said partial condensate.

9. A method of claim 8 wherein the curing is effected at elevated temperatures in the range of from 75° to 125°C.

10. A method of claim 8 wherein the partial condensate is that of $CH_3Si(OH)_3$.

11. A method of claim 8 wherein the binder composition contains from 0.1 to 1.5 weight percent of a buffered latent silanol condensation catalyst.

12. A method in accordance with claim 11 wherein the catalyst is an alkali metal salt of a carboxylic acid.

13. A method in accordance with claim 12 wherein the catalyst is sodium acetate.

14. A method in accordance with claim 8 wherein the acid is selected from the group consisting of acetic acid, formic acid, propionic acid and maleic acid.

* * * * *

UNITED STATES PATENT AND TRADEMARK OFFICE

CERTIFICATE OF CORRECTION

PATENT NO. : 3,944,702

DATED : March 16, 1976

INVENTOR(S) : Harold A. Clark

It is certified that error appears in the above-identified patent and that said Letters Patent are hereby corrected as shown below:

In Column 6, line 47; the word reading "weighting" should read "weighing".

In Column 6, line 48; the line reading "suring 100 mm. 33 305 mm. was placed on the cured" should read "suring 100 mm. x 305 mm. was placed on the cured".

In Column 9, line 11; the line reading "weight $RSiO_{3/2}$ in which R is selected from the group" should read "weight percent $RSiO_{3/2}$ in which R is selected from the group".

In Column 9, line 17; the word reading "witn" should read "with".

In Column 9, line 19; the word reading "witn" should read "with".

Signed and Sealed this

Eighth Day of December 1981

[SEAL]

Attest:

GERALD J. MOSSINGHOFF

Attesting Officer

Commissioner of Patents and Trademarks